US005491912A

United States Patent [19]

Snabb et al.

[11] Patent Number: 5,491,912

[45] Date of Patent: Feb. 20, 1996

[54] ATHLETIC SHOES WITH REVERSE SLOPE CONSTRUCTION

[76] Inventors: John C. Snabb, 3440 Dorothea Ct., Troy, Mich. 48084; Clifford Larkins, 510 Pearl St., Ypsilanti, Mich. 48197

[21] Appl. No.: 166,243

[22] Filed: Dec. 13, 1993

Related U.S. Application Data

[63] Continuation-in-part of Ser. No. 896,222, Jun. 10, 1993, abandoned.

[51] Int. Cl.[6] ..... A43B 5/00; A43B 3/00; A43B 13/00

[52] U.S. Cl. ..... 36/114; 36/25 R; 36/113; 36/127

[58] Field of Search ..... 36/25 R, 91, 127, 36/11.5, 114, 30 R, 116, 113

[56] References Cited

U.S. PATENT DOCUMENTS

| | | | |
|---|---|---|---|
| 2,390,416 | 12/1945 | Bettman | 36/11.5 X |
| 2,518,649 | 8/1950 | Tydings et al. | 36/11.5 X |
| 2,769,252 | 11/1956 | Monier | 36/140 |
| 3,859,727 | 1/1975 | Nakamoto | 36/11.5 |
| 3,964,181 | 6/1976 | Holcombe, Jr. | 36/91 |
| 3,990,159 | 11/1976 | Borgeas | 36/101 |
| 4,589,216 | 5/1986 | Fuscone | 36/32 R |
| 4,934,073 | 6/1990 | Robinson | 36/25 R X |
| 5,075,984 | 12/1991 | Shiew | 36/113 |
| 5,265,354 | 11/1993 | Aliano, Jr. | 36/127 |

*Primary Examiner*—Paul T. Sewell
*Assistant Examiner*—BethAnne C. Cicconi
*Attorney, Agent, or Firm*—James M. Deimen

[57] ABSTRACT

New application of biomechanical principles of elastic stretch and braking force are combined in an athletic shoe. The new design implements the concepts by placing the heel significantly lower than the ball of the foot and toes. Tests show that an inner sole reverse slope of about 3½° provides an optimum significant improvement in jumping in particular. The reverse slope is substantially flat from the center of pressure beneath the heel to the five centers of pressure beneath the ball of the foot. The flat slope provides more assurance that the weight of the user will be applied to the shoe through the centers of pressure in preference to locations under the arch. The invention is applicable to "explosive" movement sports such as basketball, track and field, volleyball, tennis and soccer. Preferably the shoes are constructed with formed or curved heels to retain the feet properly positioned in the shoes by preventing the feet from sliding too far back within the shoes. The increased athletic performance appears to arise from a two fold effect. First, the reverse slope because of the toe elevation additionally stretches the achilles tendon resulting in the ability to generate greater jumping force as the calf muscle contracts. Second, the reverse slope because of the continuous flat nature of the slope, provides a greater stopping or braking force, thus improving the ability to convert forward momentum into vertical or lateral motion.

10 Claims, 1 Drawing Sheet

ATHLETIC SHOES WITH REVERSE SLOPE CONSTRUCTION

This application is a continuation-in-part of application Ser. No. 07/896,222, filed 10 Jun. 1993, now abandoned.

BACKGROUND OF THE INVENTION

The field of the invention pertains to athletic shoes and, in particular, to athletic shoes specifically for use in "explosive" sports such as basketball, track and field, volleyball, tennis and soccer.

Modern athletic shoes for sports, in particular sports with explosive movements, are designed and constructed to place the heel significantly higher than the balls of the feet and toes. Typically the slope of the inner sole is at 4° and higher at the heel relative to the ball and toes and thus have a forward slope. Such athletic shoes are constructed in this manner to provide better shock absorption and greater comfort. The forward slope provides a tendency to lift the arch of the foot from the inner sole when braking thus protecting the arch from injury.

However, for certain specific purposes shoes have been disclosed with heel inner soles lower than the inner sole at the ball of the foot and toes. Perhaps the best known example is disclosed in U.S. Pat. No. 3,305,947, the "earth shoe" wherein the heel inner sole is level with or slightly lower than the inner sole at the ball of the foot. This shoe is a walking shoe commercially sold as a sandal with straps and not suited for vigorous athletic activities beyond walking.

U.S. Pat. No. 3,964,181 discloses a shoe to improve the posture of a wearer but nevertheless appear as a conventional shoe. The heel portion is substantially hollowed out to put the heel at 2° –10° reverse slope below the ball of the foot. The inner sole is substantially curved both laterally and longitudinally between the heel and ball of the foot. The preferred slope is 5°. The shoe construction is specifically directed to overcome the sandal appearance and fitting problems of the "earth shoe" design and be applicable to dress shoes and casual shoes such as wing tips, moccasins, brogues and wedges. Thus, this shoe construction is not directed to vigorous athletic activities.

A walking shoe for enhanced exercise is disclosed in U.S. Pat. No. 4,934,073. A reverse slope convex wedge is positioned ahead of the heel and terminating before the heel. The convex wedge also terminates before the ball. Here again, the shoe is not directed to vigorous athletic activities beyond walking. Both of the above walking shoes purposely provide arch support and with such arch support at least a portion of the user's weight is applied through the arch.

A number of devices have been specifically developed for physical therapy that embody a severe reverse slope U.S. Pat. No. 2,769,252 discloses a block affixed to the exterior shoe sole under the ball of the foot and toes. The block creates a severe reverse slope. The shoe construction is to aid in the strengthening of the abdominal muscles by causing an abnormal walking posture. The shoe design clearly would be unsuitable for athletic activities beyond the intended walking exercise.

U.S. Pat. Nos. 3,472,508 and 4,573,678 disclose severe reverse slope devices for exercising the lower leg. Both devices are attached to the feet with straps, the former being intended for feet without shoes and the latter intended for feet in athletic shoes. The former device also provides for an adjustable slope. Both devices are intended for walking with the devices strapped on, however, they are too cumbersome and dangerous for vigorous sports activities.

U.S. Pat. No. 4,526,365 discloses a platform device having a resilient wedge shaped member under the toes and ball of the foot. The wedge creates a reverse slope relative to the heel support of the device. The March 1992 issue of Track & Field News on page 57 refers to platformed spikes by NIKE® as training and competition shoes having a platform on the front, however, no illustration or detailed explanation is provided.

SUMMARY OF THE INVENTION

The new athletic shoes are constructed with the heel significantly lower than the ball of the foot and toes to provide a reverse slope inner sole. The inner soles of the shoes increase in height at a constant rate from the horizontal beginning at the center of pressure of the heel and extending beyond the five centers of pressure in the ball of the foot before leveling off to a constant thickness or 0° slope. For purposes of this disclosure the center of pressure of the heel comprises the portion of the heel beneath the rearward portion of the calcaneus bone. Similarly, the five centers of pressure of the ball comprise the portions of the ball beneath the forwardmost portions of the tarsal bones. These definitions encompass the various centers of pressure that change position on the foot depending on the position of the foot as the foot and shoe strike the ground whether jumping or braking. In a dynamic situation (running, jumping, braking) the overall center-of pressure of the foot moves generally on a path from the heel to the ball. The inner sole reverse slope is substantially flat both laterally and longitudinally from the center of pressure beneath the heel to the five centers of pressure beneath the ball of the foot. If the increasing height is discontinued before the ball of the foot, the braking effect of the reverse angled inner sole will be reduced. This will negatively affect the shoes's performance enhancement. However, leveling off the soles'increasing thickness near the toe of the shoe will not decrease its braking effect and will provide a takeoff surface angle more perpendicular to the direction of motion. This will result in a more effective final ball/toe pushoff. Furthermore, the flat reverse slope design has been found to be more comfortable when the inner sole is level near the toe.

By using the flat reverse slope design placing the heel lower than the ball, tests by applicants have shown that explosive movement such as running and jumping are substantially improved. The athlete can jump higher and farther and can run faster. The tests have shown that the optimum reverse or negative slope of the inner sole from the center of pressure of the heel to the ball centers of pressure is about 3½ .The flat reverse slope provides more assurance that the weight of the user will be applied to the shoe through the centers of pressure in preference to locations under the arch. Thus, the arch of the foot, which is relatively weak is protected in sudden stops and braking. Preferably, the shoes are constructed with formed or curved heels to retain the feet properly positioned in the shoes by preventing the feet from sliding too far back within the shoes.

The increased athletic performance appears to arise from a two fold effect. First, the reverse slope tends to additionally stretch the achilles tendon resulting in the ability to generate greater jumping force as the calf muscle contracts. Second, the continuous nature of the flat reverse slope provides a greater stopping or braking force, thus improving the ability to convert forward momentum into vertical or lateral motion. Since the instantaneous weight of the user can increase ten to twelve fold in sudden braking, a continuous negative flat slope from the heel center of pressure to the ball centers of pressure of the foot retained a proper negative flat slope under such increased weight is very important to reduce the likelihood of excessive impact load on the arch.

In summary, improved performance is seen in three areas of explosive motion:

a) Increased vertical jump height b) Increased acceleration and foot speed c) Quicker directional changes and stops d) Reduced likelihood of foot injury

DESCRIPTION OF THE PREFERRED EMBODIMENTS.

Figure 1:
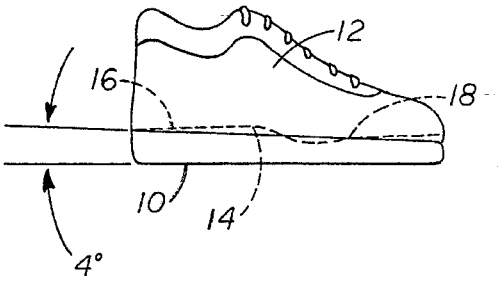
FIG 1 PRIOR ART
FIG. 1 illustrates schematically the current shoe design with a positive slope.

In FIG. 1 the typical prior art athletic shoe design is illustrated. The shoe comprises an outer sole 10 and upper 12 attached thereto. Within the shoe is an inner sole 14 stepped or sloped downwardly from the heel 16 toward the ball of the foot and toes at 18. The slope is about 4° positive as indicated.

Figure 2:
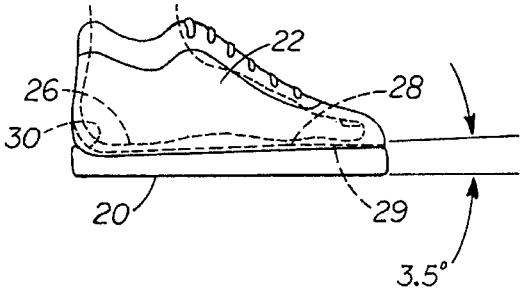
FIG. 2 illustrates schematically the new shoe design with a negative slope.

FIG. 2 illustrates the new shoe with an outer sole 20 and upper 22 attached thereto. Within the shoe is an inner sole 24 sloped upwardly relative to the horizontal from the heel 26 toward the ball of the foot at 28. These locations 26 and 28 are the approximate centers of pressure at the heel and ball of a foot respectively as shown in FIG. 2. The slope is preferably about 3½ negative or reverse as indicated. The slope is preferably changed to 0° under the toes as indicated at 29. The inner sole 24 is substantially flat both laterally and longitudinally from rearward the center of pressure of the heel to forward of at least the five centers of pressure of the ball of the foot. The centers of pressure are the weight bearing locations on the foot wherein the bone structure causes the weight of the user to be concentrated in normal-standing, walking or running. These locations on the foot are most able to withstand the sudden impact loading of jumping and braking which may increase the instantaneous load on the foot to ten to twelve times the weight of the user.

Figure 3:
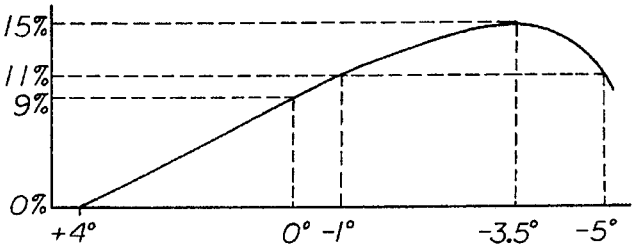
FIG. 3 is a graph of percentage increase in performance in jumping versus the angle of the shoe inner sole construction.
Figure 4A:
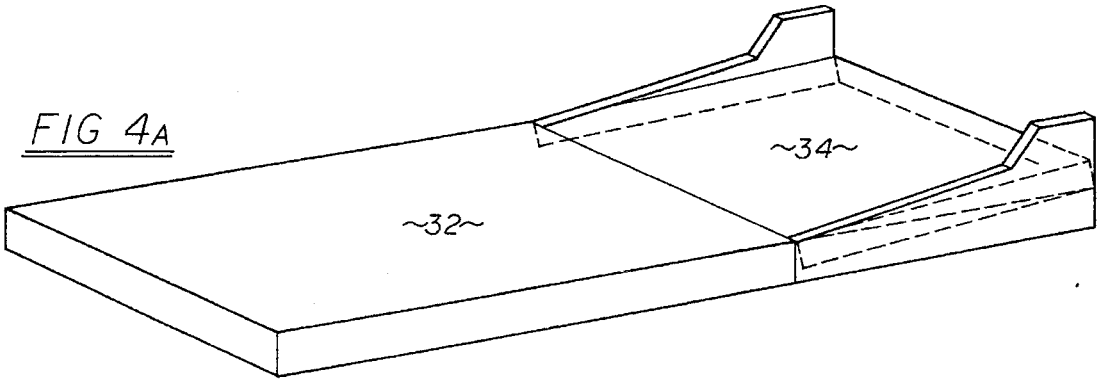
FIG. 4 is a perspective view of an adjustable test platform to simulate a negative slope athletic shoe.
FIG. 4B is a side view of the test platform.
FIG. 4C illustrates the jump test on the platform.
Figure 4B:
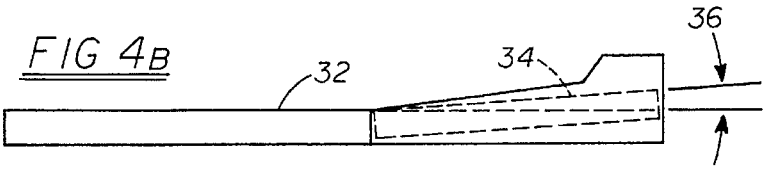
Figure 5:
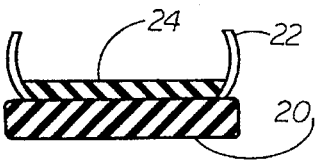
FIG. 5 is a partial transverse sectional view of the shoe taken between the heel and ball centers of pressure showing a laterally flat inner sole.
Figure 4C:
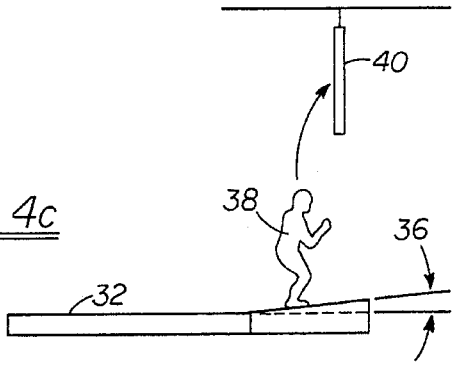

The preferred negative slope was determined through extensive testing by the applicants, one of whom is a professor of kinesiology at the University of Michigan, Ann Arbor, MI. The test results for vertical jump are summarized in the graph shown in FIG. 3 and are based on one of two completed vertical height studies. The vertical height studies were performed as a result of initial tests with modified athletic shoes. To assume uniformity of test procedure, the adjustable test platform shown in FIG. 4 was constructed. The test platform comprises a fixed level portion 32 and a tiltable portion 34. The tiltable portion is supported securely at each selected test angle 36. Each test athlete can be tested barefoot or with the same shoes at all test slopes, thereby eliminating shoe variability. As shown in FIG. 4C each test subject 38 jumped to touch a backboard 40.

The first study was of the standstill two foot jump. The reverse slope design resulted in an increase in jump height of, on average, eight percent over the current shoe design (4° positive slope). The second study was on the two foot jump with a one and a half step approach. The reverse slope design produced a fifteen percent increase in jump height relative to the current shoe design and is shown in FIG. 3. A preliminary study using a higher speed approach and a one foot takeoff indicates even greater percentage increases are possible.

FIG. 3 illustrates that the improvement begins with a lessening of the slope from the current 4° positive and a peak improvement occurring at about 3.5° negative. Further negative slope beyond 3.5° results in a fall off in improvement that becomes drastic beyond 5° . Thus, for substantial improvement in athletic performance based on the tests shown in FIG. 3, the sole slope should be between 1° and 5° negative but preferably 3½° negative.

Based upon more informal trials and use by the applicants in competitive sports, basketball, volleyball and tennis, an immediately apparent significant improvement in performance was experienced. The testing has also shown that a curved heel as indicated in FIG. 2 at 30 is beneficial to prevent sliding backward in the shoe. Moreover, the applicants have determined from the testing that braking and cutting in explosive sports is enhanced by the negative slope, in particular, the negative slope shown in FIG. 2 wherein the slope is flat and constant from the center of pressure of the heel 26 to the ball centers of pressure of the foot 28. Forward of the ball 28 centers of pressure the negative slope is decreased to 0° under the toes at 29. The change in slope occurs beyond the ball centers of pressure as shown.

Any suitable inner sole material that will properly support and cushion the foot while retaining the proper negative slope may be used. A wide variety of such materials and constructions have been developed in recent years. As an alternative for athletes that may wish to further "tweak" their shoes to enhance their personal performance or to eliminate the reverse angle when not competing, the ball of the foot and toe portion of the inner sole or the heel of the inner sole may be constructed of open cell foam material with the surface sealed air tight. Connecting the inner sole to an athletic shoe air pump permits the inner sole to be pumped up or bled to adjust the effective negative slope. Fitted inserts placed on the inner sole can also accomplish the adjustment of the slope.

The eight percent and fifteen percent improvements obtained in the tests above can be translated into enhanced performance improvement by highly trained talented competitors at the professional or Olympic level. Such improvements on this order are to be very unexpected from flattening and a change of a few degrees in the slope of the inner sole of the shoe. Yet they can be expected because the tests were performed with well trained athletes from a local University under the supervision of one of the applicants. Moreover, the research shows that the optimum reverse angle of 3½ the well trained athletes but also to other individuals regardless of size, strength or conditioning.

We claim:

1. A running, jumping and braking athletic shoe comprising a horizontal outer sole and an inner sole thereabove, an upper attached to at least one of the outer sole and inner sole adjacent the periphery thereof, the inner sole elevated above the outer sole at a location defined by a ball of a foot being higher than the inner sole is elevated above the outer sole at a location defined by a heel of a foot to form a negative slope, the improvement comprising the inner sole negative slope being substantially flat laterally across the shoe and longitudinally from a heel location rearward of a location defined by the center of pressure at the heel of a foot at least to ball locations defined by the centers of pressure at the ball of a foot, said negative flat slope retained a proper negative substantially flat slope under the application of multiple times the weight of the user to the heel and ball centers of pressure, whereby the likelihood of excessive impact loading of the user's arch is reduced and the arch protected.

2. The athletic shoe of claim 1 wherein the inner sole flat negative slope is within an angular range of 1° to 5° relative to the horizontal outer sole.

3. The athletic shoe of claim 1 wherein the inner sole flat negative slope is at an angle of 3½° relative to the horizontal outer sole for optimum enhancement of athletic performance.

4. The athletic shoe of claim 1 wherein the inner sole is curved upward behind the heel of a foot to prevent backsliding of the foot within the shoe.

5. The athletic shoe of claim 1 wherein the sole continuosly increases in thickness from the heel location to the ball locations of the foot and the sole is substantially constant in thickness from the centers of pressure of the ball of the foot forward under the toes.

6. An athletic shoe for enhanced athletic performance comprising a sole with an outer surface, an inner surface and a periphery, an upper attached to the periphery, said sole supporting the ball and toes of a foot above the heel of the foot relative to the outer surface at horizontal, said sole effectively increasing in thickness at a constant rate from a heel location rearward a location defined by the center of pressure at the heel of a foot to a ball location forward of a location defined by the forwardmost center of pressure at the ball of a foot to thereby form a flat inner negative slope, said flat inner negative slope extending laterally across the shoe, said flat inner negative slope retained a substantially flat proper negative slope under the application of multiple times the weight of the user to the heel and ball centers of pressure whereby the likelihood of excessive impact loading of the user's arch is reduced, and the arch protected, and the inner surface forward of the flat inner negative slope being sloped at a lesser angle to horizontal than the slope of the flat inner negative slope.

7. The athletic shoe of claim 6 wherein the flat inner negative slope is from 1° to 5° relative to horizontal.

8. The athletic shoe of claim 6 wherein the flat inner negative slope is optimized at about 3½° relative to the horizontal.

9. The athletic shoe of claim 6 wherein the inner surface slope forward the ball of a foot forwardmost center of pressure is about 0°.

10. The athletic shoe of claim 6 wherein the inner sole is curved upward at the back of the heel of a foot to prevent backsliding within the shoe.

* * * * *